US011180934B2

(12) United States Patent
Ney et al.

(10) Patent No.: US 11,180,934 B2
(45) Date of Patent: Nov. 23, 2021

(54) CINCH OVERRIDE MECHANISM FOR LATCH ASSEMBLY

(71) Applicant: Inteva Products, LLC, Troy, MI (US)

(72) Inventors: Daniel Alexander Ney, Lake Orion, MI (US); Donald Michael Perkins, Sterling Heights, MI (US); Ian Dow, Bloomfield, MI (US); Adam Mather, Bloomfield Hills, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 603 days.

(21) Appl. No.: 16/042,443

(22) Filed: Jul. 23, 2018

(65) Prior Publication Data

US 2020/0024872 A1 Jan. 23, 2020

(51) Int. Cl.

| | |
|---|---|
| ***E05B 77/32*** | (2014.01) |
| ***E05B 79/08*** | (2014.01) |
| ***E05B 81/20*** | (2014.01) |

(52) U.S. Cl.

CPC ..... *E05B 77/32* (2013.01); *E05B 79/08* (2013.01); *E05B 81/20* (2013.01)

(58) Field of Classification Search

CPC ..... E05B 77/32; E05B 77/00; E05B 79/08; E05B 79/00; E05B 81/20; E05B 81/00;

(Continued)

(56) References Cited

U.S. PATENT DOCUMENTS 5,288,115 A * 2/1994 Inoue ..... E05B 81/20 292/201
5,423,582 A * 6/1995 Kleefeldt ..... E05B 81/20 292/201

(Continued)

FOREIGN PATENT DOCUMENTS

CN 104074413 A 10/2014
CN 104343295 A 2/2015

(Continued)

OTHER PUBLICATIONS

English Machine Translation of Abstract DE10114065.

(Continued)

*Primary Examiner* — Kristina R Fulton
*Assistant Examiner* — Christopher F Callahan
(74) *Attorney, Agent, or Firm* — Cantor Colburn LLP

(57) ABSTRACT

An override mechanism for a cinching latch assembly includes a claw rotatable between open and closed positions, the claw spring biased toward the opened position to allow opening of a latch. Also included is a cinch drive link rotatable between an override and non-override positions, the cinch drive link in operative contact with the claw in the non-override position and disengaged from the claw in the override position, wherein operative contact between the claw and the cinch drive link biases the cinch drive link toward the override position. Further included is a guide surface. Yet further included is a cinch override lever defining an opening, the bearing of the cinch drive link disposed within the opening and moveable within the opening. Also included is a cinch override pawl rotatable between an engaged condition and a disengaged condition, the engaged condition locking the cinch override lever.

15 Claims, 11 Drawing Sheets

(58) Field of Classification Search
CPC ..... E05B 63/0065; E05B 81/21; E05B 81/90; Y10T 292/1047; Y10T 292/1082; Y10S 292/23
See application file for complete search history.

(56) References Cited

U.S. PATENT DOCUMENTS

| | | | | |
|---|---|---|---|---|
| 5,899,508 | A * | 5/1999 | Cetnar | E05B 81/16 292/216 |
| 6,382,687 | B1 * | 5/2002 | Gruhn | E05B 81/14 292/201 |
| 6,550,825 | B2 * | 4/2003 | Ostrowski | E05B 81/20 292/199 |
| 10,000,949 | B2 | 6/2018 | Vazquez et al. | |
| 10,513,873 | B2 | 12/2019 | Tomaszewski et al. | |
| 10,731,388 | B2 | 8/2020 | Ilea et al. | |
| 10,844,639 | B2 | 11/2020 | Nelsen | |
| 2017/0089103 | A1 * | 3/2017 | Ottino | E05B 81/06 |
| 2018/0155965 | A1 | 6/2018 | Estrada et al. | |

FOREIGN PATENT DOCUMENTS

| | | | |
|---|---|---|---|
| CN | 104956019 | A | 9/2015 |
| CN | 105421909 | A | 3/2016 |
| DE | 10114065 | A1 | 11/2002 |
| DE | 202013102505 | U1 | 6/2013 |
| DE | 102016220142 | A1 | 11/2017 |
| EP | 0393595 | A2 | 10/1990 |
| EP | 3059362 | A1 | 8/2016 |
| WO | 03071064 | A1 | 8/2003 |

OTHER PUBLICATIONS

English Machine Translation of Abstract DE202013102505.
European Search Report for Application No. EP 18 20 4111.
Written Opinion for Application No. EP 18 204111; dated May 21, 2019.
CN First Office Action for Application No. 201811083947.8; dated Sep. 17, 2020.
CN Search Report for Application No. 201811083947.8.
English Translation to CN First Office Action for Application No. 201811083947.8; dated Sep. 17, 2020.

* cited by examiner

CINCH OVERRIDE MECHANISM FOR LATCH ASSEMBLY

BACKGROUND

The subject matter disclosed herein relates to latch assemblies and, more particularly, to a cinch override mechanism for such latch assemblies.

Some cinching latch assemblies require that the associated door must stop cinching the door closed when a release event is initiated (i.e., user is attempting to open the door), thus allowing the door to be opened. Such a mechanism must be capable of interrupting a cinching event once the event has been initiated. If failure of the assembly occurs at some point during the event, there must be capability to override the mechanism via a release operation, either electrically or mechanically. If this is achieved by reversing a cinch actuator, then the user may become trapped if the actuator loses power or fails, or if a cable or cable lever jams. Therefore, an assembly that does not provide a mechanical way to override the cinching function during any manual or power release event is undesirable.

SUMMARY

Disclosed herein is an override mechanism for a cinching latch assembly. The assembly includes a claw rotatable between an opened position and a closed position, the claw spring biased toward the opened position to allow opening of a latch. Also included is a cinch drive link rotatable between an override position and a non-override position, the cinch drive link in operative contact with the claw in the non-override position and disengaged from the claw in the override position, wherein operative contact between the claw and the cinch drive link biases the cinch drive link toward the override position. Further included is a guide surface extending from the cinch drive link. Yet further included is a cinch override lever defining an opening, the bearing of the cinch drive link disposed within the opening and moveable within the opening. Also included is a cinch override pawl rotatable between an engaged condition with the cinch override lever and a disengaged condition with the cinch override lever, the engaged condition locking the cinch override lever to oppose movement of the cinch drive link to the override position.

Also disclosed herein is an override mechanism for a cinching latch assembly. The assembly includes a claw rotatable between an opened position and a closed position, the claw spring biased toward the opened position to allow opening of a latch. Also included is a cinch drive link rotatable between an override position and a non-override position, the cinch drive link in operative contact with the claw in the non-override position and disengaged from the claw in the override position, wherein operative contact between the claw and the cinch drive link biases the cinch drive link toward the override position. Further included is a bearing extending from the cinch drive link. Yet further included is a cinch override lever defining an opening, the bearing of the cinch drive link disposed within the opening and moveable within the opening, the cinch override lever spring biased to rotate in a direction that opposes movement of the cinch drive link toward the override position.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawing in which:

Figure 1:
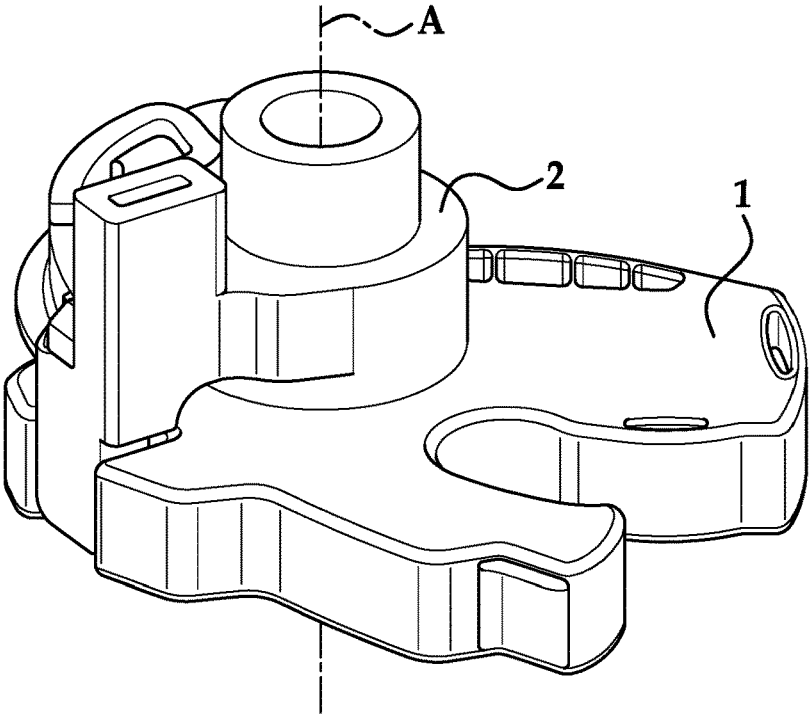
FIGS. 1-5 illustrate portions of a cinching latch assembly.

The detailed description explains embodiments of the invention, together with advantages and features, by way of example with reference to the drawing.

DETAILED DESCRIPTION OF THE INVENTION

Referring to the Figures, a cinching mechanism for a latch assembly is illustrated. The cinching mechanism may be employed with numerous types of latch assemblies, including vehicle doors. As described herein, the disclosed embodiments allow for the cinching mechanism to stop driving a claw closed during any type of release event, thereby providing an override system to provide a safety function that avoids passenger entrapment if the passenger needs to release the door during any cinching event, power failure during a cinching event, cinch actuator failure, cinch cable jam or failure, or cinch cable lever jam or failure. The cinching mechanism also provides the ability for the latch to function normally regardless of the status of the cinching mechanism. If any of the above-noted failures occur, the latch assembly will still be able to fully cycle from an opened status to a closed/latched status, and vice versa. The cinching mechanism also provides the override function with minimal added efforts onto the release system.

Throughout the Figures, the cinching mechanism is generally referenced with numeral 10. Components are progressively discussed, with certain features omitted from some Figures to more clearly illustrate the structural and functional details of each component.

Figure 2:
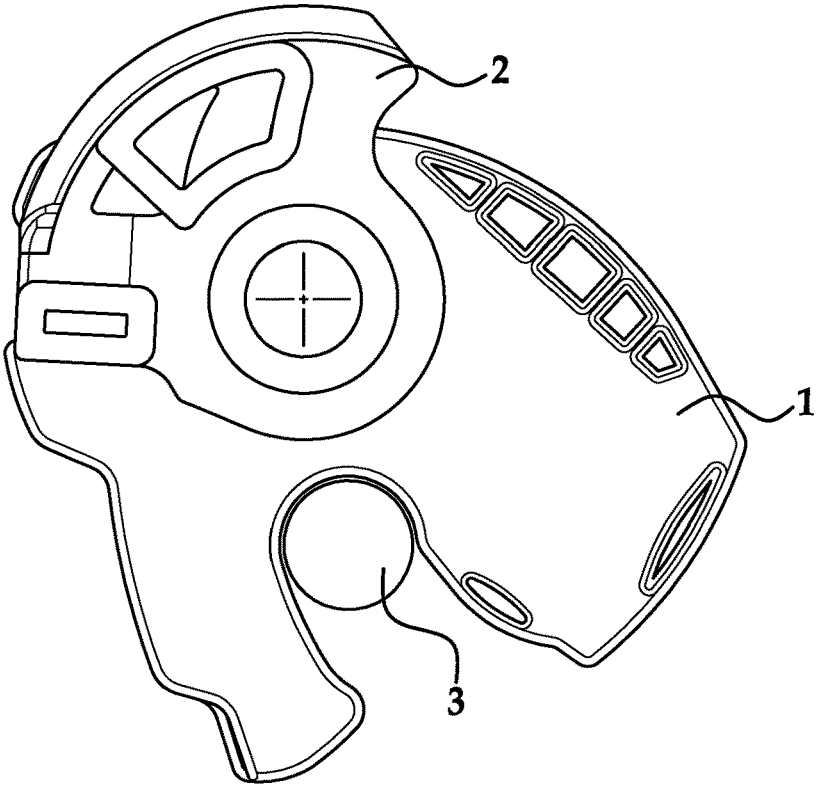

Referring to FIGS. 1 and 2, a claw 1 and a claw drive lever 2 are illustrated. The claw 1 and the claw drive lever 2 are coupled together—directly or indirectly—and pivot about the same axis A. The claw drive lever 2 drives the claw 1 to a closed position during a cinching event of the latch assembly, and contains a return spring that releases the claw 1 during an opening event. During a cinching event, the claw 1 will pull a striker 3 into a recess of the claw 1 as the claw 1 rotates from a secondary position to primary position of the claw 1, as shown in FIG. 2.

Figure 3:
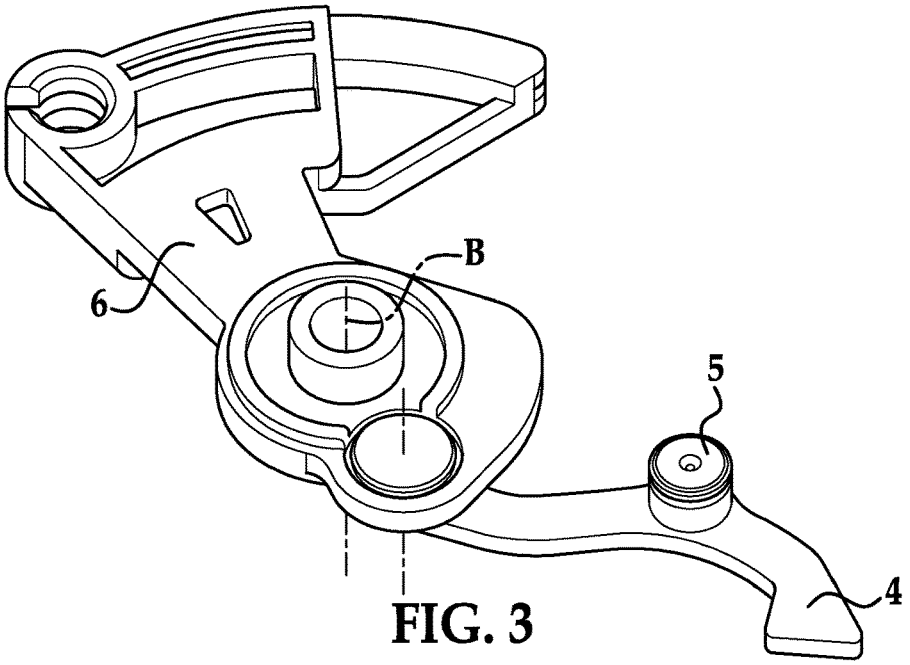

FIG. 3 illustrates a cinch drive link 4, a cinch cable lever 6 and a drive link bearing 5. The cinch drive link 4 is riveted to the cinch cable lever 6 at an offset from the cinch cable lever's 6 axis B, and serves as the driving lever that engages with the claw drive lever 2 to cinch the latch closed. The drive link bearing 5 is riveted to the cinch drive link 4 and provides low friction for the override system.

Figure 4:
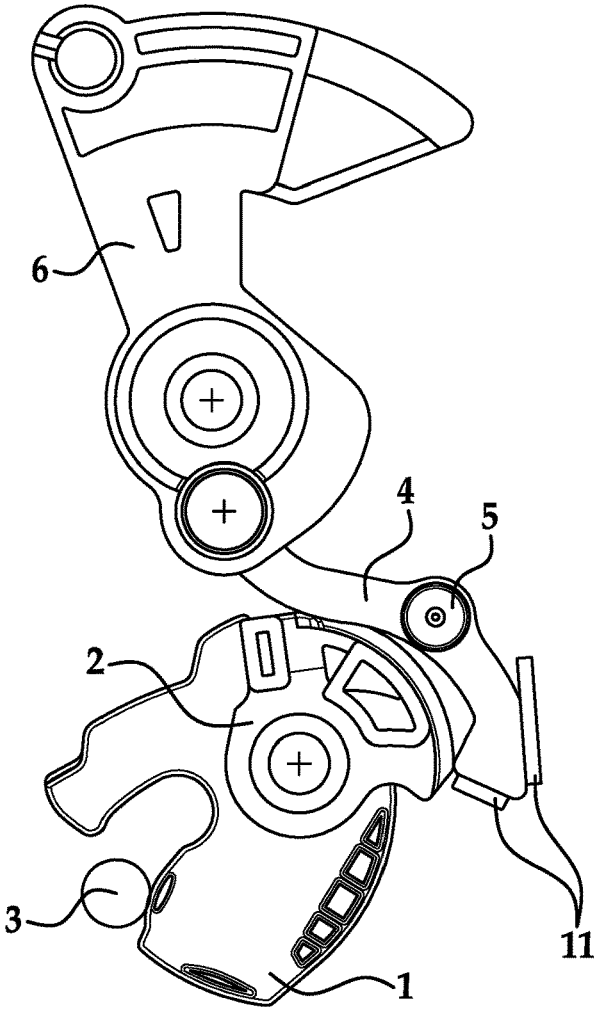
Figure 5:
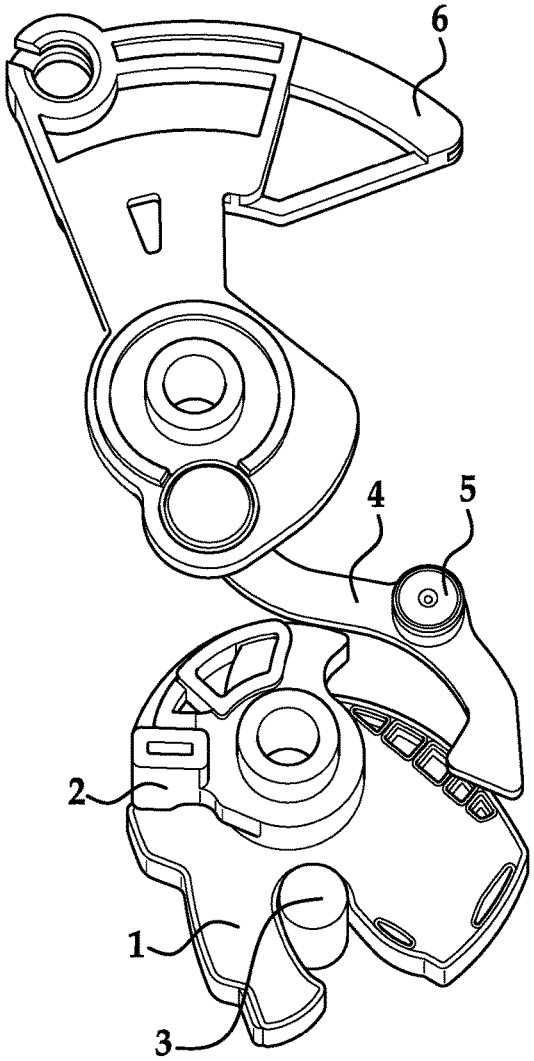

FIGS. 4 and 5 show the relationship between the cinch cable lever 6, the cinch drive link 4, the claw 1 and the claw drive lever 2. In the illustrations, the cinch cable lever 6 and the cinch drive link 4 are in a home position. One or more housing features 11 retain the cinch drive link 4 in a position that keeps it free of the claw's movement during normal operation. The claw 1 and the claw drive lever 2 are able to move freely, without interference, when the cinch cable lever 6 and cinch drive link 4 are in their home position.

Figure 6:
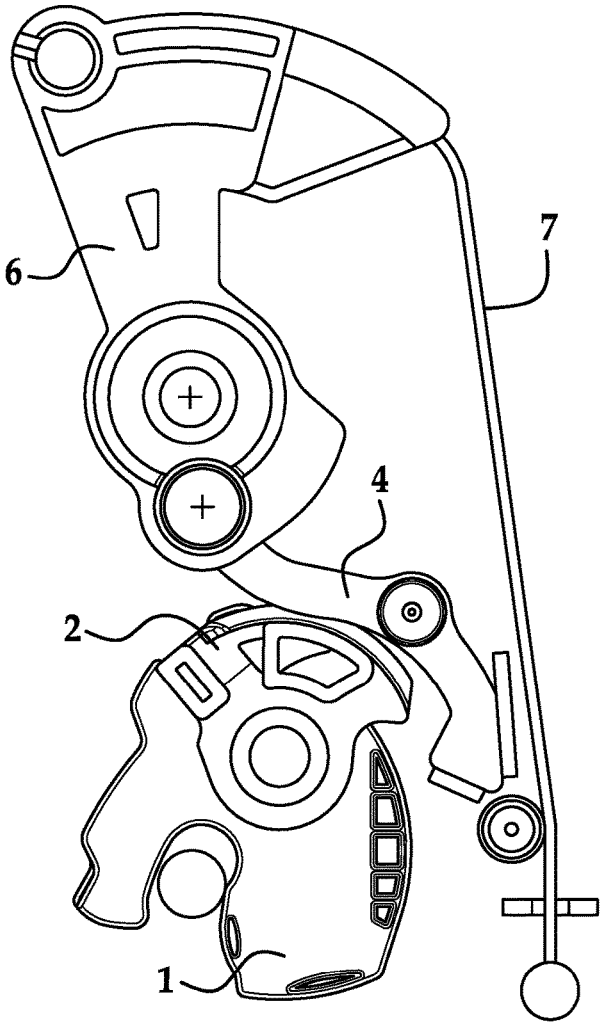
FIGS. 6-12 illustrate the cinching latch assembly in various positions.
Figure 7:
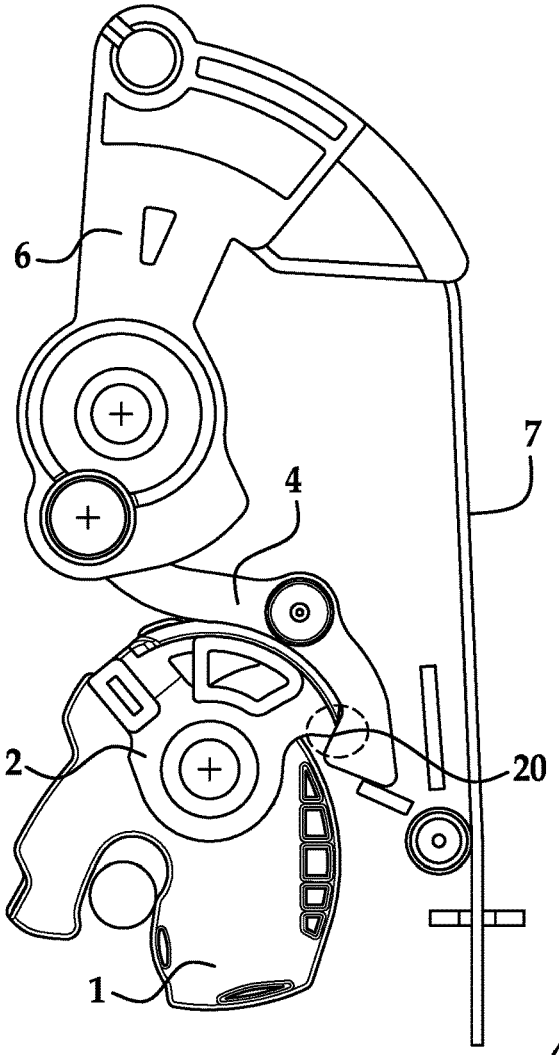
Figure 8:
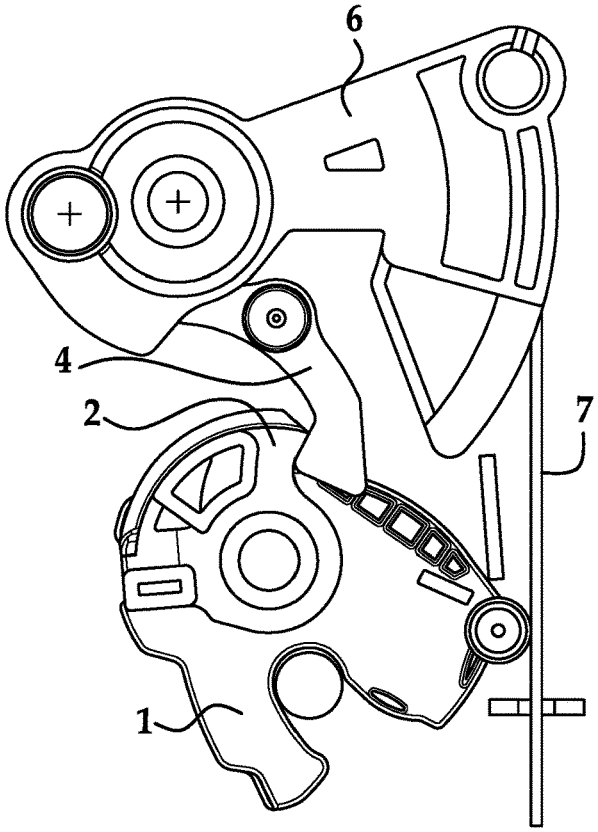

FIGS. 6-8 illustrate the process of the cinching function from a primary to a secondary position. The cinch cable lever 6 is pulled by a cable 7 which is driven by a remote actuator (not shown), and pulls the cinch drive link 4 to come into contact with a tooth 20 of the claw drive lever when it is in, or past, the secondary position. FIG. 6 shows the cinch drive link 4 in home position and the claw drive lever 2 in the secondary position. FIG. 7 shows the cinch cable lever 6 being pulled by the cable 7, and the cinch drive link 4 making contact with the claw drive lever's tooth 20. FIG. 8 shows the final state of the cinch drive link 4, with the claw drive lever 2 having passed primary position and fully latched. The cinch cable lever 6 and cinch drive link 4 will return to their home position via a return spring as the remote actuator reverses the cable 7 back.

Figure 9:
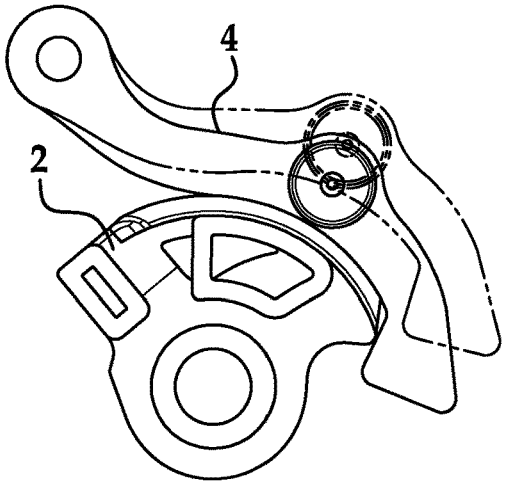
Figure 10:
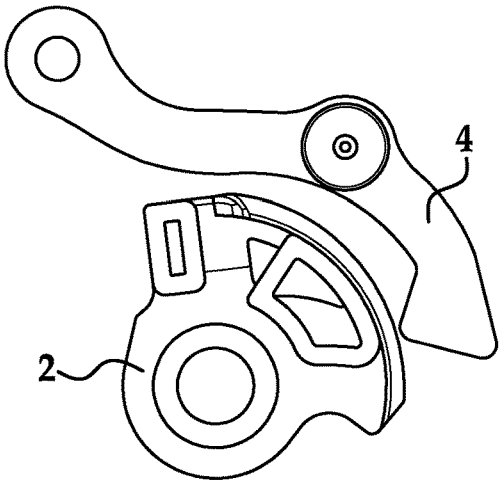
Figure 11:
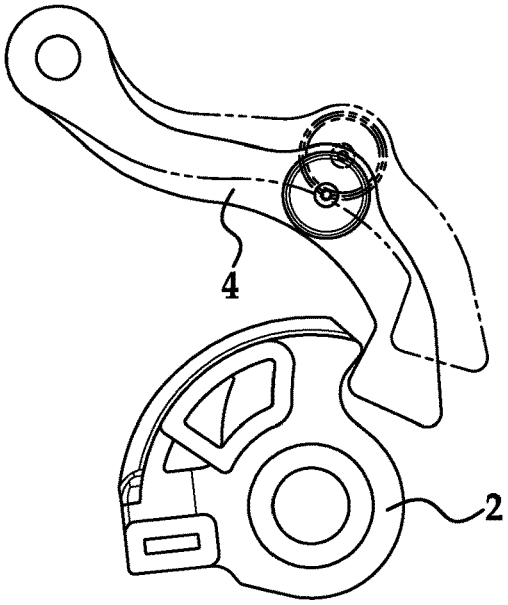
Figure 12:
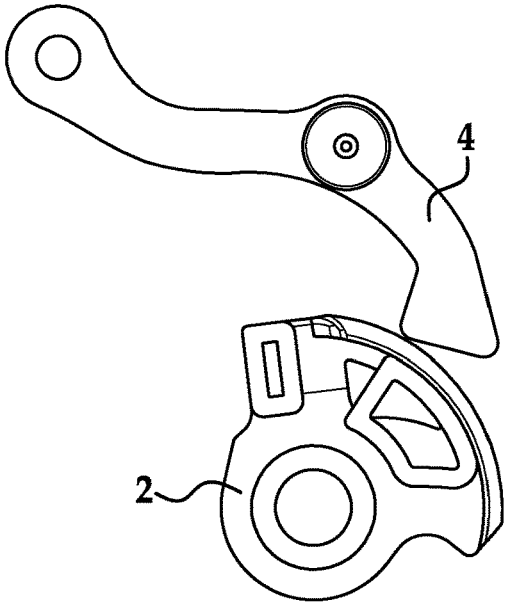

FIG. 9-12 show the cinch drive link's 4 movement as it disengages from the claw drive lever 2, and moves to an "override" position. FIG. 9 displays the claw drive lever 2 in secondary position and shows the cinch drive link 4 moving from a "non-override" to an "override" position. FIG. 10 shows the cinch drive link 4 in its "override position" from secondary, and the claw drive lever 2 returned to an open position. FIG. 11 displays the claw drive lever 2 in primary position and shows the cinch drive link 4 moving from a "non-override" to an "override" position. FIG. 12 shows the cinch drive link 4 in its "override position" from primary, and the claw drive lever 2 returned to an open position.

Figure 13:
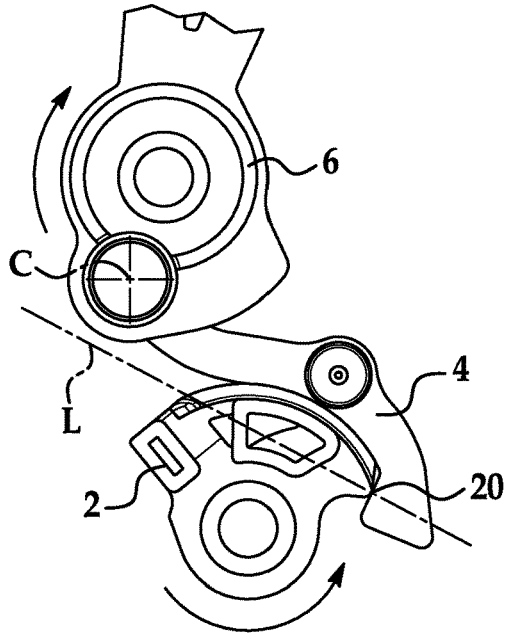
FIGS. 13-19 illustrate various kinematic relationships of the cinching latch assembly.
Figure 14:
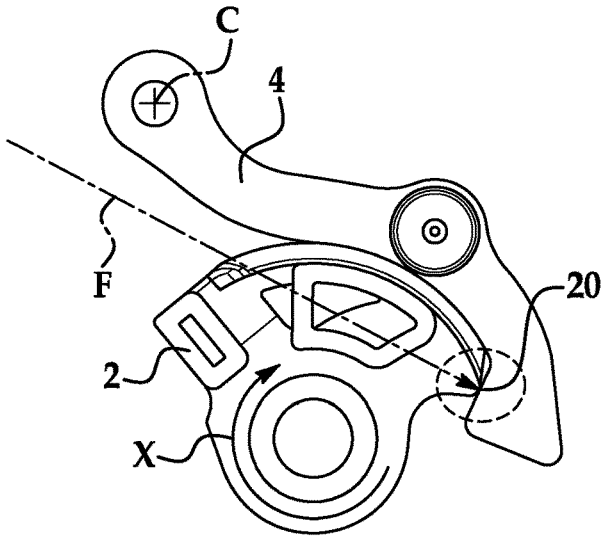
Figure 15:
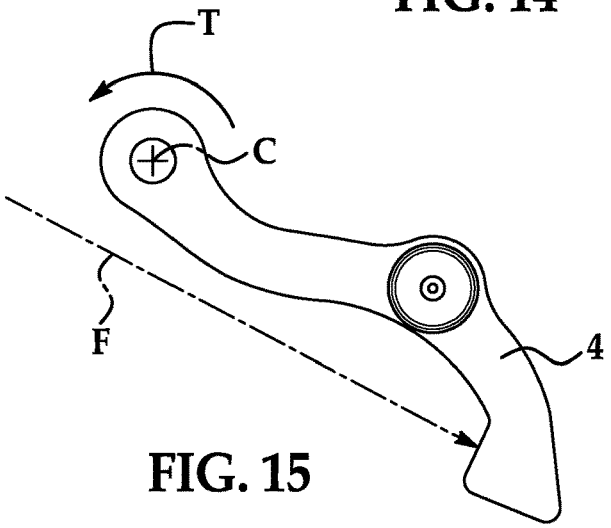
Figure 16:
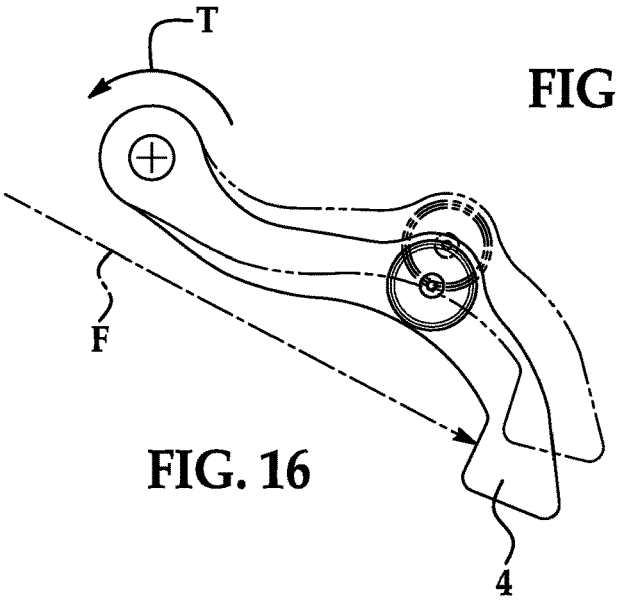

FIGS. 13-16 illustrate geometry associated with the cinching mechanism 30 that facilitates the override functions described herein. The profile of the cinch drive link 4 that drives the claw drive lever 2 creates a force vector that does not normally drive into the axis A of rotation of the claw drive lever 2. FIG. 13 shows the line of action L of the force vector created between the cinch drive link 4 and the claw drive lever's tooth 20 as the claw drive lever 2 is driven closed. FIG. 14 shows rotation X of the claw drive lever 2 caused by a return spring of the claw drive lever 2. Due to the rotation of the claw drive lever 2, and any seal loads on the system, a force is driven back on the cinch drive link 4 that is not normal to its pivot point C. FIG. 15 shows that due to this force vector F, a resulting torque, which is described as "back out torque" and referenced with T, is created on the cinch drive link 4. FIG. 16 illustrates the back out torque T forces the cinch drive link 4 to naturally want to rotate off of the tooth of the claw drive lever 2, therefore freeing the claw drive lever 2 to rotate open.

Figure 17:
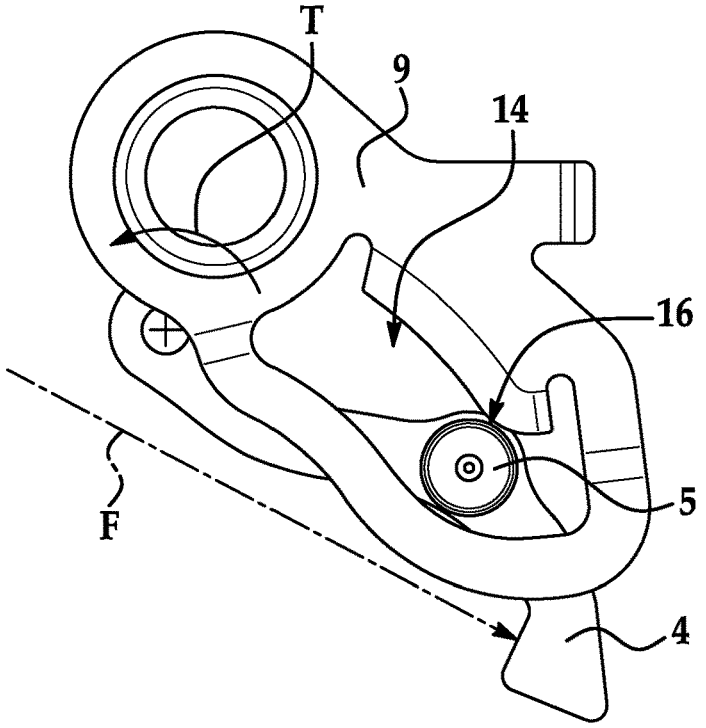
Figure 18:
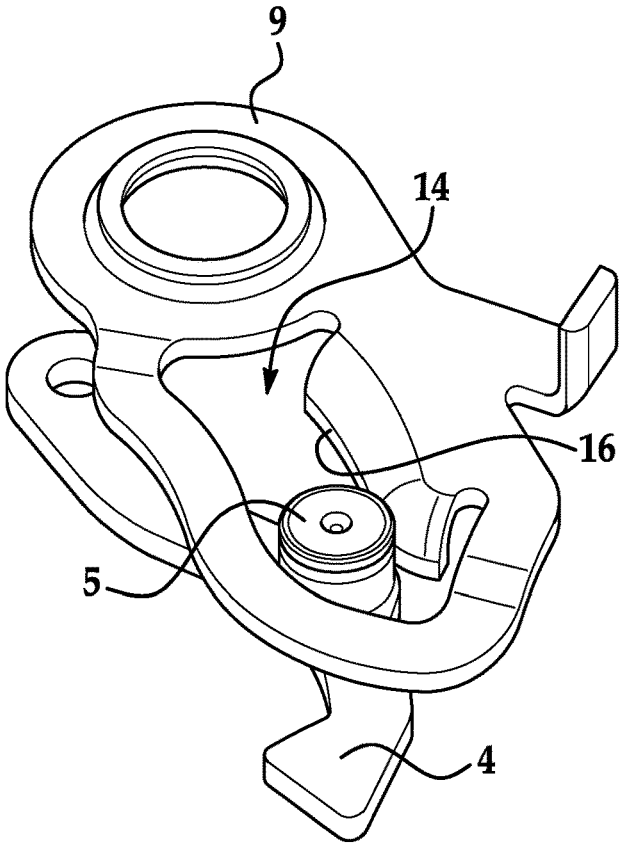

FIGS. 17 and 18 show the cinch drive link 4, the drive link bearing 5, and a cinch override lever 9. Due to the back out torque T, the cinch drive link 4 naturally wants to rotate counterclockwise off of the claw drive lever's tooth 20. To keep the cinch drive link 4 in contact with the claw drive lever 2, the cinch override lever 9 is used to oppose the back out torque T on the cinch drive link 4. The drive link bearing 5 rides along the profile of the cinch override lever 9 which provides the opposing force to keep the cinch drive link 4 and the claw drive lever 2 engaged. In the illustrated embodiments, the bearing 5 is disposed within an aperture 14 defined by an inner wall 16 of the cinch override lever 9.

Figure 19:
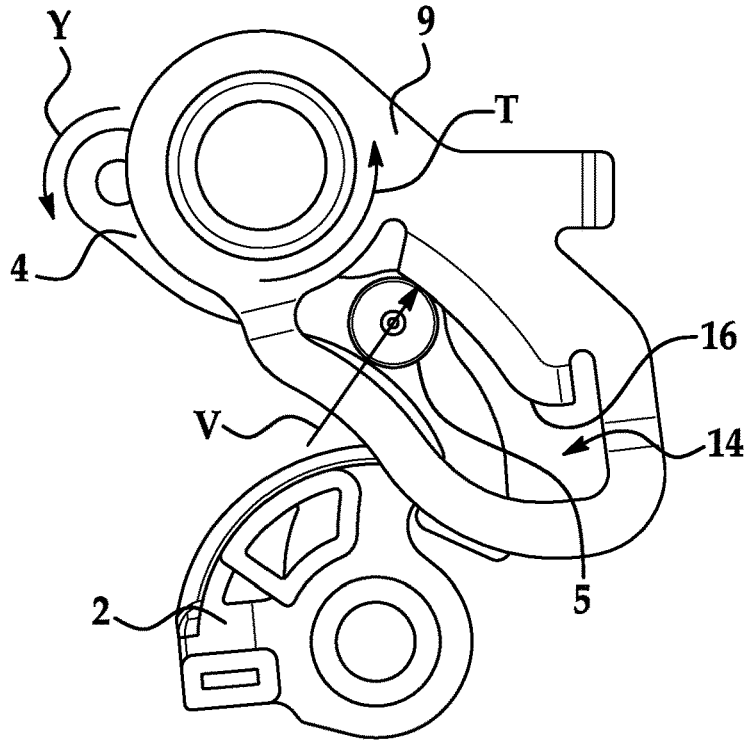

FIG. 19 displays the cinch drive link's 4 role in moving the cinch override lever 9 to an "override" position. The back out torque T acting on the cinch drive link 4 creates a force vector V normal to the drive link bearing 5 and the cinch override lever 9. This force vector V creates a torque Y on the cinch override lever 9 that forces a counterclockwise rotation on it. When the cinch override lever 9 is free to move, the cinch drive link 4 is able to become disengaged with the claw drive lever 2 and move into an "override" position, which allows for the claw drive lever 2 to freely move to an open position, therefore releasing the latch.

Figure 20:
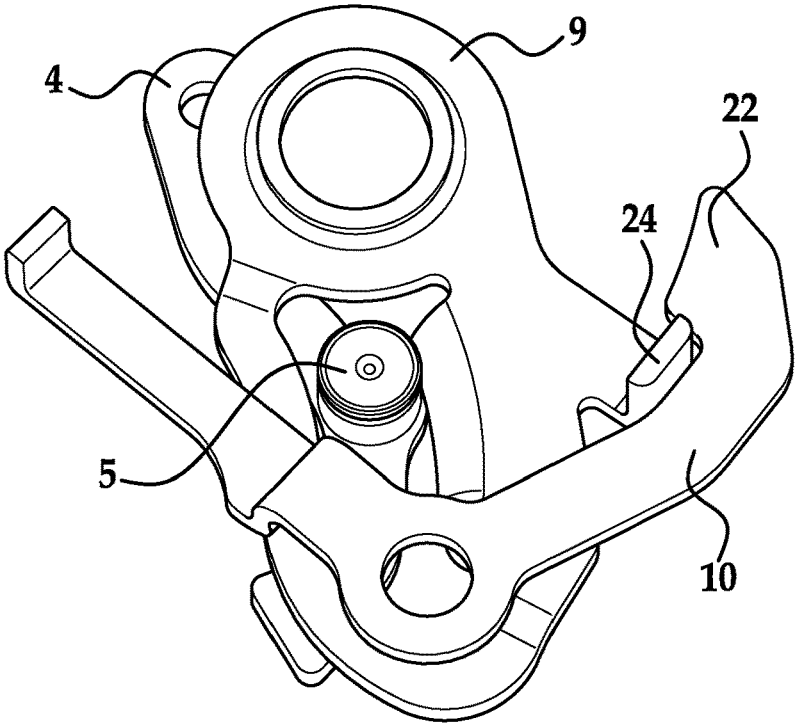
FIGS. 20 and 21 illustrate engaged and disengaged conditions of a cinch override lever and a pawl.
Figure 21:
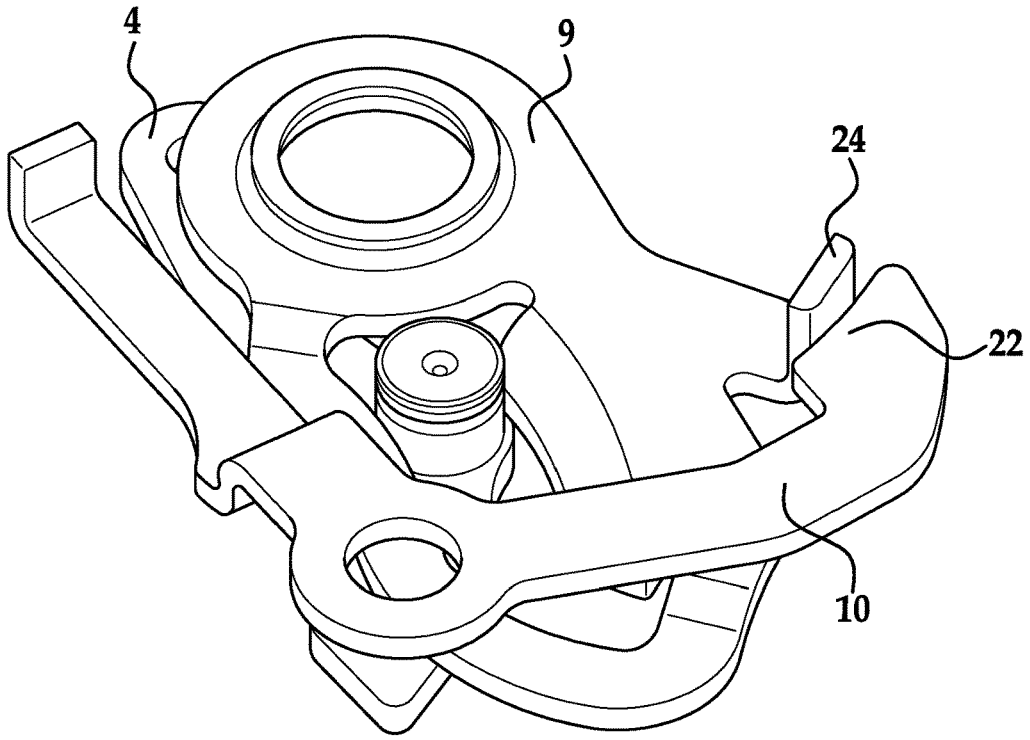

FIGS. 20 and 21 illustrate the cinch drive link 4, drive link bearing 5, cinch override lever 9, and a cinch override pawl 10. Since the cinch drive link 4 naturally wants to drive itself and the cinch override lever 9 into the "override" position, a cinch override pawl 10 is used to hold the cinch override lever 9 in a "non-override" position, which in turn keeps the cinch drive link 4 in an engaged position with the claw drive lever 2. FIG. 20 shows the system in a "non-override" position. In particular, a retention arm 22 of the cinch override pawl is in engagement with a tab 24 of the cinch override lever 9 to maintain the rotational position of the cinch override lever 9. The cinch override pawl 10 is in a bite condition with the cinch override lever 9, which keeps the cinch drive link 4 and the cinch override lever 9 in a "non-override" position. The cinch override pawl 10 may be actuated to release the tab 24, allowing for the cinch override lever 9 and the cinch drive link 4 to move to an "override" position if back out torque T is applied. FIG. 21 displays the position change of the cinch override lever 9 as it moves from its "non-override" position to its "override" position. The cinch override lever 9, the cinch override pawl 10, and the cinch drive link 4 is then in an "override" position. The cinch override pawl 10 is naturally returned counterclockwise from a return spring, and rests on the tab 22 of the cinch override lever 9 until it returns back to a "non-override" position.

Figure 22:
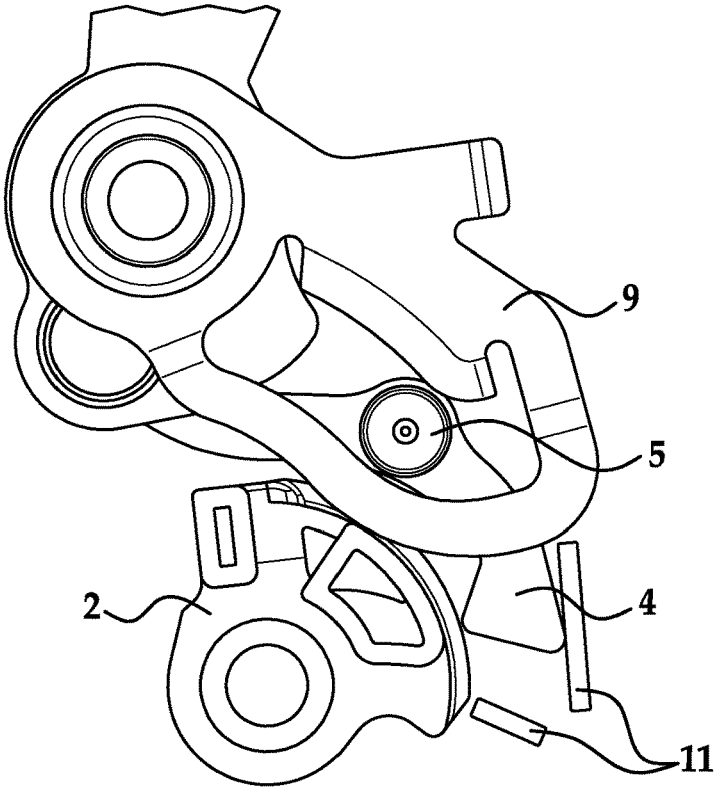
FIGS. 22 and 23 illustrate a cinch drive link guided to a non-override position with housing features.
Figure 23:
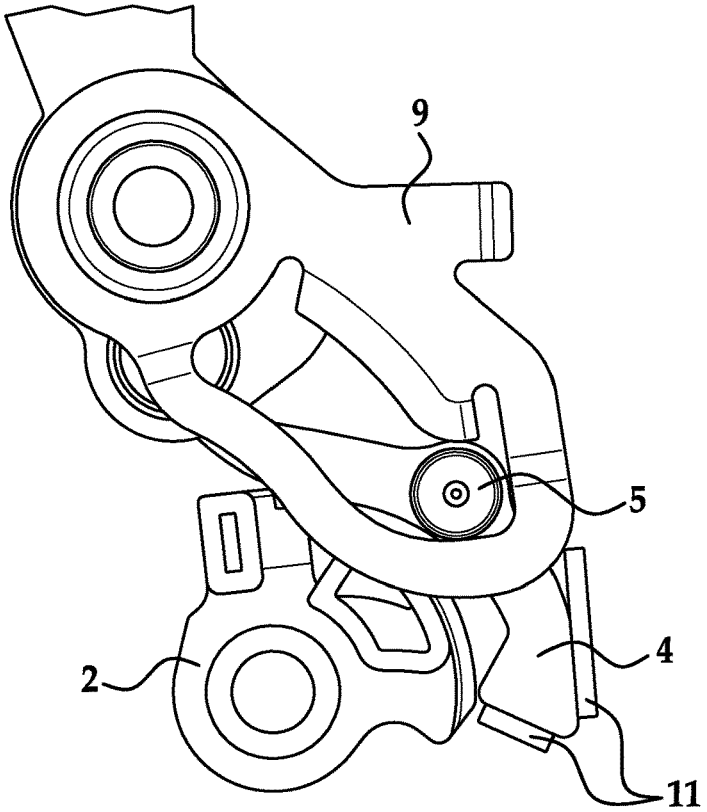

FIGS. 22 and 23 displays the sequence for returning the cinch override lever 9 from an "override" position to a "non-override" position. As the cinch drive link 4 is moving back towards its home position, housing features 11 are present that align it to only have one possible position when home. Where the cinch drive link 4 is in an "override" or "non-override" position as it returns, the housing features 11 will guide it in, and the drive link bearing 5 will pull the cinch override lever 9 back into a "non-override" position. Once the cinch override lever 9 is in a "non-override" position, the cinch override pawl 10 can close back into a bite condition.

Figure 24:
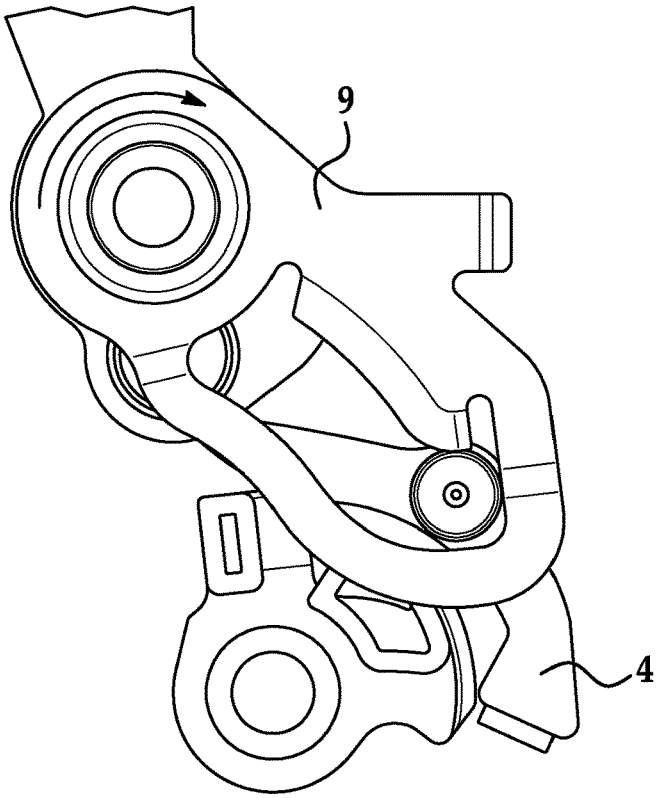
FIG. 24 illustrates a spring biased cinch override lever.

FIG. 24 displays the alternative method of returning the cinch override lever 9 to its home position. A return spring can be used to rotate the cinch override lever 9 to its home position depending on the best fit for the application. The return spring 12 will rotate the cinch override lever 9 counterclockwise, which in turn drives the cinch drive link 4 to its home position as well.

Figure 25:
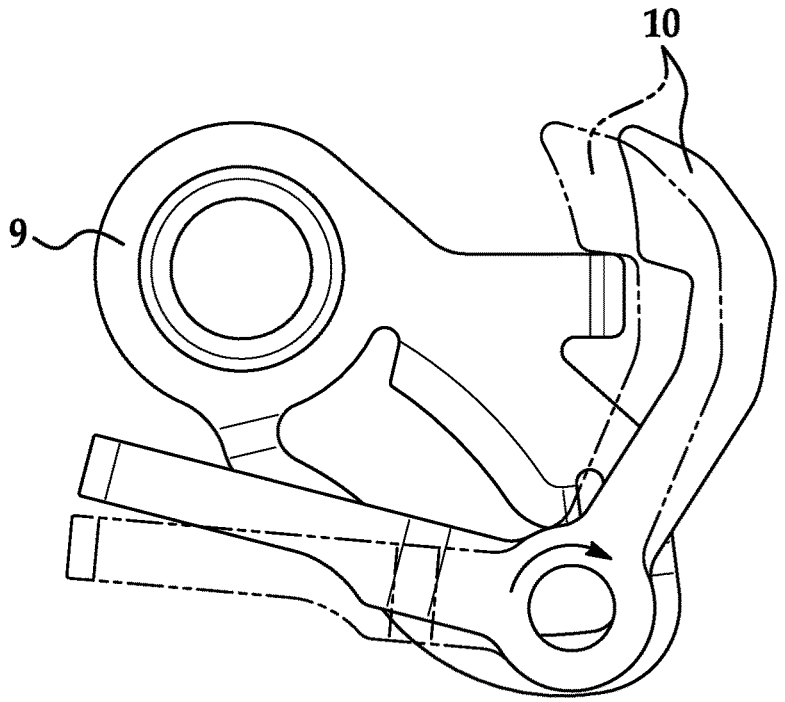
FIGS. 25 and 26 illustrate various positions of a pawl and cinch override lever according to another aspect of the disclosure.
Figure 26:
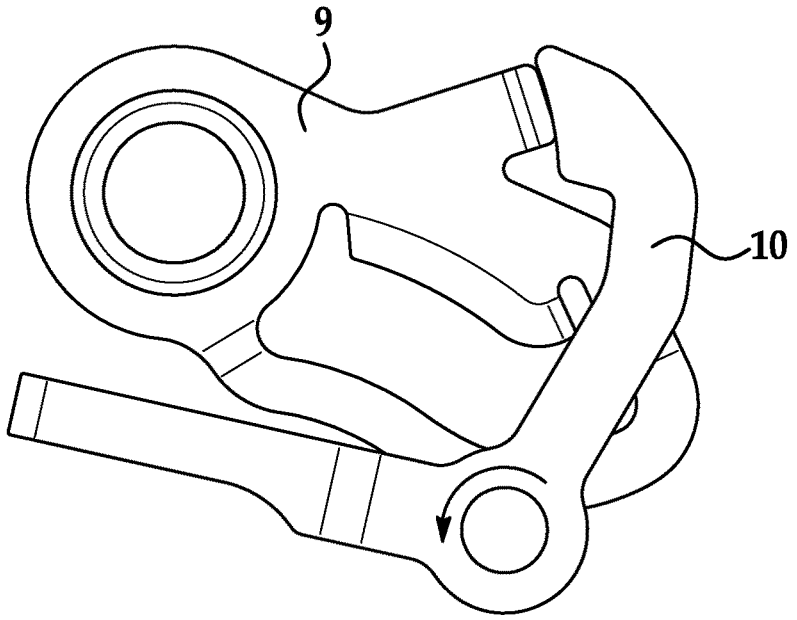

FIGS. 25 and 25 illustrate the actuation of the cinch override pawl 10. FIG. 25 shows the pawl release system will drive the cinch override pawl 10 clockwise during any release event. FIG. 26 shows if the system is in an "override" state, the Pawl Release System, is free to return back to its home position, while the cinch override pawl 10 rests on the cinch override lever 9, and will return home when the system moves to a "non-override" state, via its return spring.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An override mechanism for a cinching latch assembly comprising:

a claw rotatable between an opened position and a closed position, the claw spring biased toward the opened position to allow opening of a latch;

a cinch drive link rotatable between an override position and a non-override position, the cinch drive link in operative contact with the claw in the non-override position and disengaged from the claw in the override position, wherein operative contact between the claw and the cinch drive link biases the cinch drive link toward the override position;

a bearing extending from the cinch drive link;

a cinch override lever defining an aperture defined by an inner wall of the cinch override lever, the bearing of the cinch drive link disposed within the aperture and moveable within the aperture;

a cinch override pawl rotatable between an engaged condition with the cinch override lever and a disengaged condition with the cinch override lever, the engaged condition locking the cinch override lever to oppose movement of the cinch drive link to the override position, wherein the cinch override lever includes a tab engageable with a retention arm of the cinch override pawl in the non-override position of the cinch drive link to restrict movement of the cinch override lever, the tab disengaged with the retention arm in the override position of the cinch override lever; and a cinch cable lever rotatably mounted about a first axis, the cinch drive link pivotably mounted to the cinch cable lever for rotation about a second axis, wherein rotation of the cinch cable lever about the first axis is actuated by a cable and wherein the first axis is offset from the second axis.

2. The override mechanism of claim 1, wherein the claw and the cinch drive link are in operative contact via a claw drive lever that drives rotation of the claw, the cinch drive link in contact with a feature of the claw drive lever.

3. The override mechanism of claim 2, wherein the feature of the claw drive lever that is in contact with the cinch drive link is a tooth.

4. The override mechanism of claim 2, wherein contact between the claw drive lever and the cinch drive link imparts a force on the claw drive lever in direction that does not intersect with the axis of rotation of the cinch drive link.

5. The override mechanism of claim 1, wherein movement of the cinch cable lever causes movement of the cinch drive link between a home position and a fully latched position.

6. The override mechanism of claim 1, wherein the cinch override pawl is spring biased to rotate the cinch override pawl to bring the tab and the retention arm into engagement.

7. The override mechanism of claim 1, further comprising at least one housing feature disposed proximate an end of the cinch drive link, the housing feature(s) guiding the cinch drive link into the non-override position.

8. The override mechanism as in claim 1, wherein the cinch override lever is spring biased to rotate in a direction that opposes movement of the cinch drive link toward the override position.

9. The override mechanism of claim 8, wherein the claw and the cinch drive link are in operative contact via a claw drive lever that drives rotation of the claw, the cinch drive link in contact with a feature of the claw drive lever.

10. The override mechanism of claim 9, wherein the feature of the claw drive lever that is in contact with the cinch drive link is a tooth.

11. The override mechanism of claim 9, wherein contact between the claw drive lever and the cinch drive link imparts a force on the claw drive lever in a direction that does not intersect with the axis of rotation of the cinch drive link.

12. The override mechanism of claim 8, further comprising a cinch cable lever pivotably coupled to the cinch drive link, rotation of the cinch cable lever actuated by a cable.

13. The override mechanism of claim 12, wherein the axis of rotation of the cinch cable lever and the cinch drive link are offset from each other.

14. The override mechanism of claim 13, wherein movement of the cinch cable lever causes movement of the cinch drive link between a home position and a fully latched position.

15. The override mechanism of claim 8, wherein movement of the bearing within a profile of the opening of the cinch override lever causes rotation of the cinch override lever.

* * * * *